US008702256B2

(12) United States Patent
Alkjær

(10) Patent No.: US 8,702,256 B2
(45) Date of Patent: Apr. 22, 2014

(54) EMERGENCY LIGHT DEVICE FOR MARINE ENVIRONMENTS

(75) Inventor: Hans Poul Alkjær, Slangerup (DK)

(73) Assignee: Alcares APS, Stenlose (DK)

( * ) Notice: Subject to any disclaimer, the term of this patent is extended or adjusted under 35 U.S.C. 154(b) by 289 days.

(21) Appl. No.: 13/121,362

(22) PCT Filed: Oct. 2, 2009

(86) PCT No.: PCT/EP2009/062816
§ 371 (c)(1),
(2), (4) Date: May 17, 2011

(87) PCT Pub. No.: WO2010/037842
PCT Pub. Date: Apr. 8, 2010

(65) Prior Publication Data

US 2011/0211331 A1 Sep. 1, 2011

(30) Foreign Application Priority Data

Oct. 3, 2008 (EP) ..... 08105488

(51) Int. Cl.
*F21V 23/06* (2006.01)

(52) U.S. Cl.
USPC ..... 362/20; 362/200; 362/186

(58) Field of Classification Search
USPC ..... 362/186, 200, 205, 20; 340/321
See application file for complete search history.

(56) References Cited

U.S. PATENT DOCUMENTS

| | | | | |
|---|---|---|---|---|
| 3,278,921 | A | 10/1966 | Horino | |
| 3,783,433 | A * | 1/1974 | Kurtz et al. | 439/82 |
| 4,796,167 | A | 1/1989 | Brown et al. | |
| 5,059,952 | A | 10/1991 | Wen | |
| 5,452,189 | A | 9/1995 | Alkjaer | |
| 5,690,413 | A | 11/1997 | Coughlin | |
| 5,748,080 | A | 5/1998 | Clay | |
| 5,921,656 | A | 7/1999 | Flood et al. | |
| 7,195,369 | B2 | 3/2007 | Shaw | |
| 7,234,831 | B1 | 6/2007 | Hanley | |
| 2004/0150987 | A1 | 8/2004 | Shaw | |
| 2007/0153507 | A1 | 7/2007 | Tarter et al. | |
| 2007/0291478 | A1 * | 12/2007 | Petzl et al. | 362/205 |

FOREIGN PATENT DOCUMENTS

| | | |
|---|---|---|
| EP | 0 573 105 | 12/1993 |
| EP | 1 479 256 | 7/2006 |
| GB | 2 297 406 A | 7/1996 |
| WO | WO 93/14971 Y | 8/1993 |
| WO | WO 2004/028896 | 4/2004 |

* cited by examiner

*Primary Examiner* — Joseph L Williams
(74) *Attorney, Agent, or Firm* — Gifford, Krass, Sprinkle, Anderson & Citkowski, P.C.

(57) ABSTRACT

The invention relates to an emergency light device for marine use comprising a housing accommodating an electronic circuit, a least one transparent dome, and a first and a second shell member, said electronic circuit comprising at least one light emitting diode provided in the at least one transparent dome, an electrical power supply comprising at least one battery of the AA, AAA or AAAA type, and at least one operating switch, said emergency light characterized in that the housing has a width which is substantially larger than the height, preferably the width is at least double or triple the height.

22 Claims, 3 Drawing Sheets

36
41.9
16.3
23.8
44.2
41.5
95
2.5
R16
R12
R5

EMERGENCY LIGHT DEVICE FOR MARINE ENVIRONMENTS

CROSS-REFERENCE TO RELATED APPLICATIONS

This application is the U.S. national phase of PCT/EP2009/062816 filed Oct. 2, 2009, which claims priority of European Patent Application No. 08105488.4 filed Oct. 3, 2008.

FIELD OF THE INVENTION

The present invention relates to emergency light devices for marine use, such as an emergency light for lifejackets and/or lifebelts, for optical signalling in emergency situations, for example emergency situations at sea. A signalling emergency light can help locating persons in emergency situations, for example missing persons at sea.

BACKGROUND OF THE INVENTION

Marine safety devices, such as life vests, life jackets, life boats and the like, must comply with the SOLAS (Safety of Life at Sea) convention provided by the IMO (International Maritime Organization). For example, lights for lifejackets must comply with specific requirements in terms of luminous intensity, source of energy, visibility, colour and frequency of flashing.

Emergency lights are known in the art:

WO 2004/028896 discloses a marking light device with a light emitting diode cast in a dome shaped member and powered by a lithium battery.

EP 1679258 describes an emergency indicator in a sealed double shell arrangement to provide impermeability to water.

U.S. Pat. No. 4,796,167 describes a water activated locus identifying device. One embodiment of this invention teaches the use of a 9 volt battery as the energy source.

WO 93/14971 discloses a compact tactical and rescue beacon with a rechargeable power source and a power switch located in a recess on the body of the beacon.

These known emergency light devices have a somewhat bulky design. To provide visibility of the emergency light in an emergency situation it must be worn on the outside of the lifejacket, preferably on the shoulder strap, because the shoulders are most likely to surface when a human wearing a lifejacket is in water. A bulky emergency light fixed to the shoulder strap increases the risk of the emergency light grapping, hitting and/or striking obstacles in an emergency situation providing an unnecessary risk for anyone caught in a life threatening situation. An object of the invention is to provide an emergency light device that is safely worn on life jackets.

Recent rule changes means that all life jackets on all merchant boats, such as cruise ships, in international waters must be equipped with an emergency light complying with SOLAS and that these emergency light devices must be replaced at least every five years. That urges the shipping lines to focus on the cost of the life jacket emergency light without however compromising the safety regulations. Thus, an object of the invention is to provide a low-cost emergency light device designed to last for at least five years.

BRIEF DESCRIPTION OF THE INVENTION

This is achieved by an emergency light device for marine use comprising a housing accommodating an electronic circuit, a least one transparent dome, and a first and a second shell member, said electronic circuit comprising at least one light emitting diode provided in the at least one transparent dome, an electrical power supply comprising at least one standard battery of the AA, AAA or AAAA type, and at least one operating switch, said emergency light characterized in that the housing has a width which is substantially larger than the height, preferably the width is at least double or triple the height.

By the present invention a slim, low cost emergency light device is provided. The emergency light device is preferably attached to a safety device, such as a life jacket or a life belt. Attachment is provided by attachment means, e.g. a clip and/or a buckle, preferably at the bottom of the housing of the emergency light device. In case of attaching to a lifejacket, the emergency light device can advantageously be attached to the shoulder strap of the lifejacket. The reduced height of the emergency light device according to the invention provides a better integration with the lifejacket minimizing protrusion of the emergency light device from said lifejacket. Most of the components of the emergency light device are manufactured in a plastics material such as polycarbonate and by means of injection molding. The further helps to keep the costs down.

In one embodiment of the invention at least one of the corners of the housing of the emergency light device is rounded, thereby avoiding at least one sharp edge. In a preferred embodiment all corners of the housing are rounded thereby minimizing the presence of sharp edges on the emergency light device. In a further embodiment of the invention at least one of the corners of the housing is substantially a circular arc. In a further embodiment each of the four corners of the housing form circular arcs, possibly circular arc of different diameters.

In a further embodiment of the invention the housing of the emergency light device is sealed, preferably permanently sealed, to prevent moist, water and/or other liquids from entering the housing comprising the electronic circuit and the electrical power source. Thereby the emergency light can be stored in a humid environment without risk of sudden malfunction. The sealing is can be provided by epoxy, for example by providing hardening epoxy to the rim of the housing when assembling the emergency light device. The sealing may also be provided by means of ultrasonic welding, which is commonly used for plastics material. This may reduce the need for bolts, nails, soldering materials, adhesives and the like, which may be necessary to bind the components together.

In a preferred embodiment of the invention the emergency light device comprises a manually operated switch. A manually operated switch provides for users to be able to manually activate and deactivate the light. A manually operated switch is required to comply with the SOLAS directive for flashing emergency lights.

A manual switch in the emergency light must be integrated in the slim design, be low-cost and easy to operate in all situations. Therefore the manually operated switch (aka manual witch) is preferably located in a recess of one of the shell members of the housing. The manual switch preferably comprises a switch handle and a switch tack. The handle (i.e. the switch handle) is for the user to activate the light and the tack (i.e. the switch tack) is to provide the corresponding electrical contact. The handle comprises an inner end and an outer end closest to the rim of the housing. The height of the switch handle preferably corresponds to the depth of the recess. Thereby the switch handle will be an integrated part of the slim emergency light, because when the switch handle is located in the recess the upper surface of the handle will be substantially level with the surface of the housing.

The recess is provided as an area of a shell member of lower thickness. In the preferred embodiment of the invention the surface bottom of the recess is substantially plane. The boundary is the "wall" defining the recess. This boundary is preferably substantially perpendicular to the surface of the recess, however the boundary is preferably at least partly rounded, such as rounded like a circular arc. The recess is preferably located in one corner of one of the shell members. In a specific embodiment of the invention the recess is an approximately 90 degrees cut-out in one corner of one of the shell members.

In the preferred embodiment of the invention the inner end of the switch handle is rounded, such as rounded substantially as a circular arc. The rounded part of the switch handle preferably corresponds substantially to the rounded part of the boundary of the recess. For the user to operate the switch the outer end of the switch handle preferably protrudes from the housing. The manually operated switch is adapted to rotate in said recess around an axis perpendicular to the plane of the housing. Preferably the part of the outer end of the switch handle that protrudes from the housing is adapted to slide along a rounded corner of the housing, such as along a rounded corner that constitutes a circular arc. I.e. operation of the manual switch can be provided by turning the switch handle in the recess and the outer end of the switch handle will then preferably match with the rounded corner of the housing and the inner end of the switch handle will the preferably match with the rounded part of the recess boundary.

To further steer and/or control the rotation of the manual switch in the recess the switch handle may comprise one or more grooves and the recess may correspondingly comprise a circular arc ridge, preferably located adjacent to a rounded corner of a shell member. The ridge and the groove(s) are then preferably adapted to engage when rotating the manual switch.

In one embodiment of the invention the switch handle is engaged to the switch tack in the axis of rotation of the switch handle. Further, the switch handle may be engaged to the switch tack by means of a trefoil shaped plug-and-socket connection. The trefoil shaped plug-and-socket connection is an efficient solution to increase the contact surface between the handle and the tack and thereby enhance the attachment. This is crucial to ensure that the switch handle remains fastened during the lifetime of the emergency light. The trefoil shape is also straightforward to manufacture by means of injection molding.

The transparent dome is preferably located on said first shell member and the recess is located on said second shell member. As the light source is located inside the transparent dome it is natural to speak of a top part of the emergency light, i.e. the part with the transparent dome. The opposite part is then the bottom part of the emergency light.

In yet another embodiment of the invention the emergency light device comprises a fluid activated operating switch. The fluid activated operating switch provides for activation of the emergency light device in case of contact with fluid, such as water. Thereby the emergency light device according to the invention is automatically activated in an emergency situation at sea. Activation of the fluid activated operating switch is preferably provided by means of a sensor connected to the electronic circuit. Said sensor provides an activation signal when contact with fluid is detected.

In a further embodiment of the invention the fluid activated operating switch can also be activated when the humidity in the air is at a certain predetermined level. The activation signal is preferably provided by a sensor, such as a humidity sensor.

BRIEF DESCRIPTION OF THE DRAWINGS

The invention will now be described in greater detail with reference to the drawings showing various illustrations of a preferred embodiment of the invention.

DETAILED DESCRIPTION OF THE DRAWINGS

Figure 2:
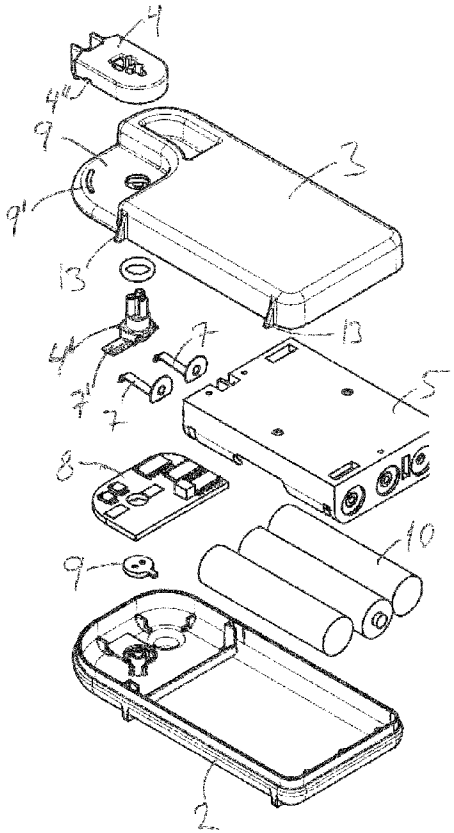
FIG. 2 is equivalent to FIG. 1, however seen from the bottom of the emergency light and without the clip.
Figure 1:
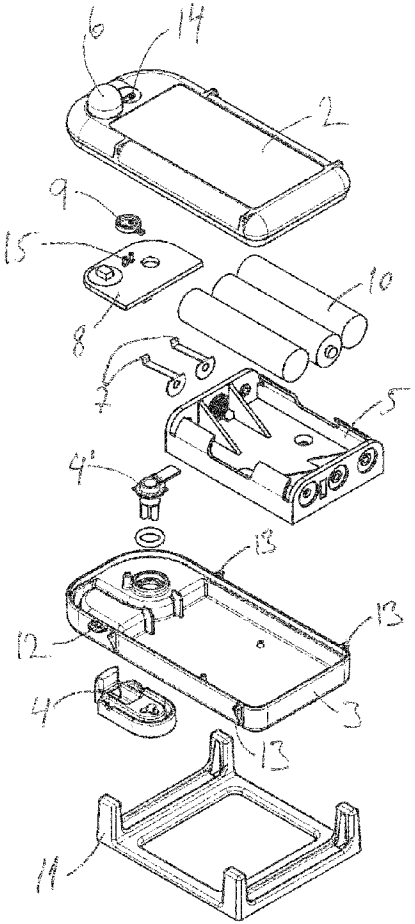
FIG. 1 is a perspective top view of a disassembled emergency light device according to the invention showing the parts of the device and the clip for fastening the device.

One embodiment of an emergency light device 1 according to the invention is illustrated in the figures. FIGS. 1 and 2 show the different components making up the device 1. The housing comprises a top part 2, whereupon the transparent dome 6 is fixed, and a bottom part 3. Inside the housing the electronic components are located, mostly on the board 8 along with the battery holder 5, batteries 10, terminals 7 and the manually operated switch. The terminals 7 are preferably metallic. The manual switch comprises the handle 4 and the tack 4'. In this illustrated embodiment the handle 4 can rotate approximately 90 degrees in the recess 9 of the bottom part 3 of the housing, whereby the emergency light 1 is activated or deactivated by means of the tack 4' providing electrical contact to the terminals 7. The light source, preferably a white LED, is located inside the transparent dome 6.

The emergency light device 1 can be fastened by means of the clip 11 (shown in FIG. 4), e.g. to the strap of a life vest. The clip 11 is preferably fixed to the device 1 by means of the grips 13. The device 1 can be further secured by means of attaching a string to the device through the eye 12.

Figure 3:
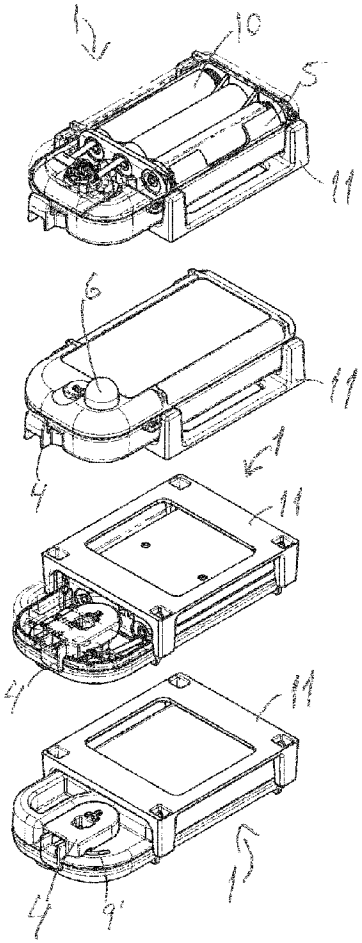
FIG. 3 shows four perspective views of the emergency light and the clip.

From FIG. 3 it is seen that the surface of the recess 9 is substantially plane except for the hole to the tack 4' and the ridge 9' shaped as a circular arc. The emergency light device 1 can be activated by means of turning the switch handle 4. A detailed view of the switch handle 4 can be seen in FIG. 13.

Figures 4, 5, 6, 7, 8, 9:
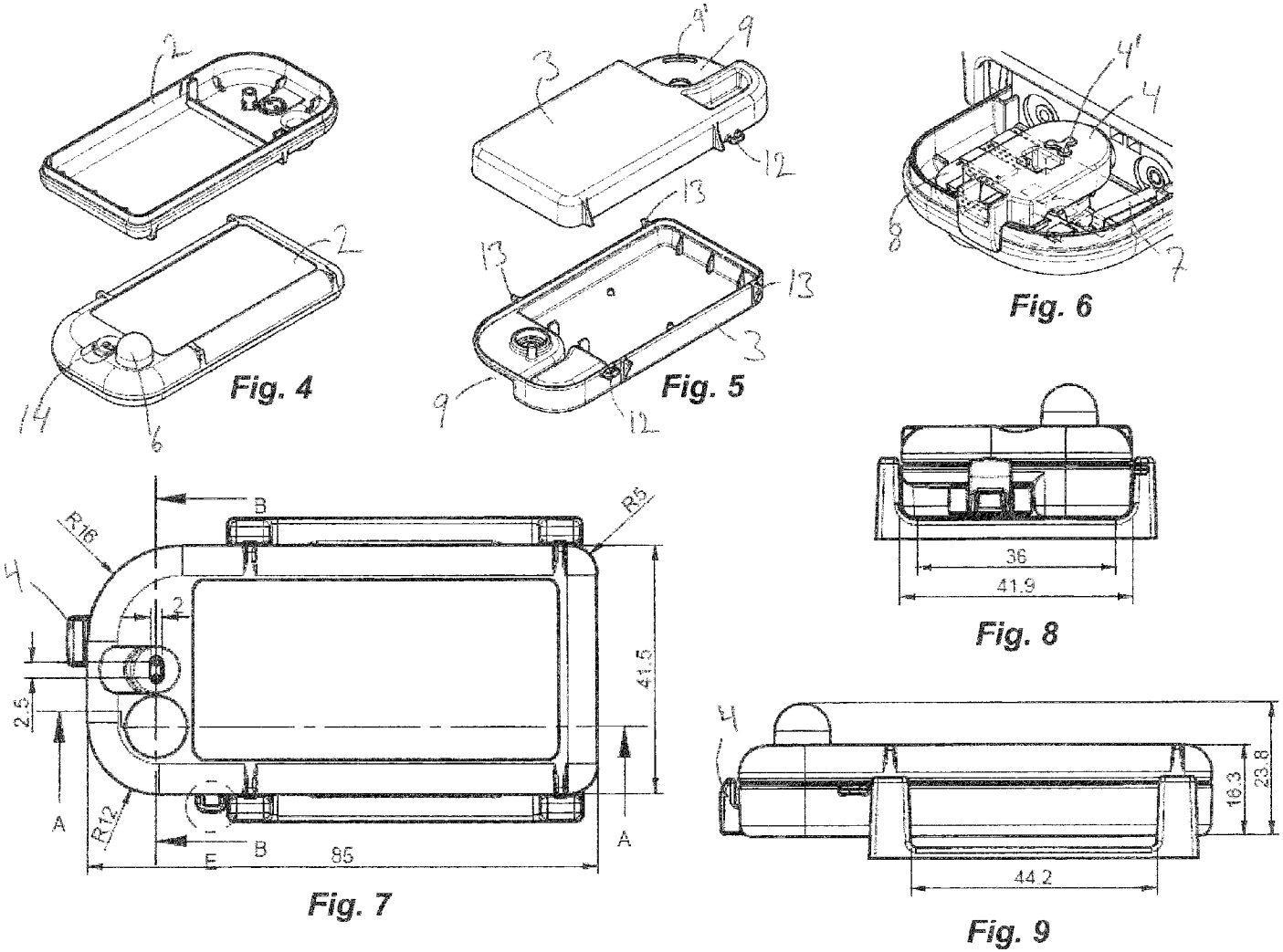
FIG. 4 shows top and bottom perspective views of the top part of the emergency light.
FIG. 5 shows top and bottom perspective views of the bottom part of the emergency light.
FIG. 6 is a close up of a manual switch in an emergency light according to the invention.
FIG. 7 is a top view of the emergency light.
FIG. 8 is an end view of the emergency light.
FIG. 9 is a side view of the emergency light.
Figure 14:
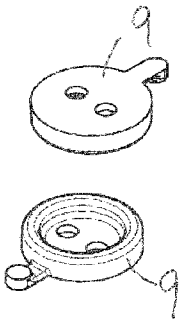
FIG. 14 shows top and bottom perspective views of a gasket.

From FIG. 7 it is seen that the corners of the housing are rounded like circular arcs with different diameters. The handle 4 is seen protruding from the housing thereby providing an easy grip for the user, however without extending too much so that the emergency light is not accidentally activated or is accidentally stuck to something. The part of the handle 4 that protrudes from the housing slides along the rounded corner when the emergency light is activated and deactivated by rotating the manual switch. It is seen that the switch handle 4 rotates around an axis perpendicular to the plane of the housing, this axis constituting the axis of engagement between the switch handle 4 and the switch tack 4'.

From the side and end views in FIGS. 8 and 9 it can be seen that the switch handle does not vertically protrude from the housing—when the switch handle is in the recess it is substantially in level with the housing.

Figure 15:
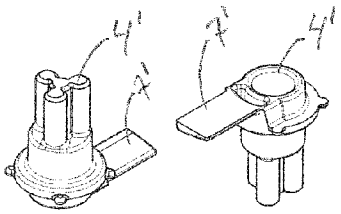
FIG. 15 shows top and bottom perspective views of the switch tack.
Figure 12:
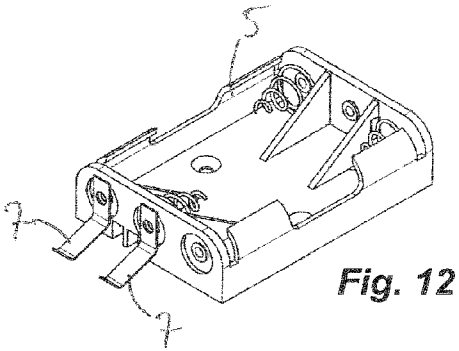
FIG. 12 is a perspective view of a battery holder.
Figure 13:
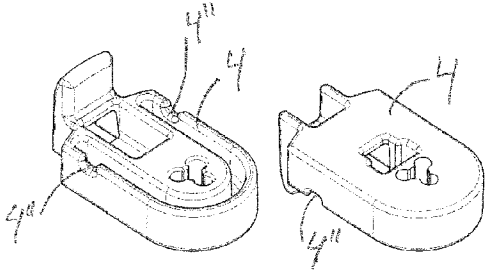
FIG. 13 shows top and bottom perspective views of the switch handle.
Figure 10:
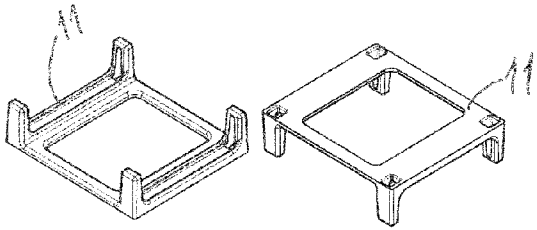
FIG. 10 shows top and bottom perspective views of the fastening clip.
Figure 11:
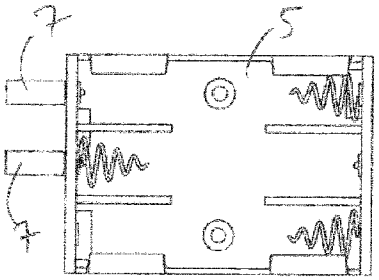
FIG. 11 is a top view of a battery holder.

FIG. 13 shows a close-up of the switch handle 4 where the grooves 4" are illustrated. These grooves 4" engage with the ridge 9' in the recess 9 when the switch handle 4 is turned. The trefoil shaped hole of the switch handle 4 matches with the trefoil shaped tack 4'seen in close-up in FIG. 15. The tack 4' also comprises a terminal 7' that provides the electrical contact when the emergency light is activated. The required rotation of the switch handle 4 for activation of the emergency light makes sure that the emergency light is not incidentally activated. This is an important functionality of an emergency light device, because accidental activation of the emergency light may result in reduced power or even no power in the batteries in an actual emergency situation.

A fluid operated switch 14 may also be comprised in the device 1. This fluid operated switch, such as a water sensor, can be located anywhere on the device but in FIG. 1 a sensor 14 is located next to the dome 6. When fluid, preferably electrically conductive fluid such as salt water, hits the depression 14 electrical contact is established between the poles 15 on the board 8 and the device 1 is immediately switched on. To prevent fluids from entering the housing a gasket 9 is provided between the depression 14 at the top of the housing and the board 8.

The top and bottom parts 2, 3 of the housing, i.e. the first and second shell members, the handle 4, the tack 4' and the clip 11 are preferably at least in part manufactured by injection moulding.

In one embodiment of the invention, the emergency light device comprises a housing with a maximum height which is less than 30 mm, preferably less than 25 mm and most preferably less than 20 mm. A preferred embodiment on the invention is the emergency light 1 illustrated in the figures, which comprises a housing with a maximum height of 16.3 mm.

In a preferred embodiment of the invention, the emergency light device comprises a housing with a maximum width which is less than 75 mm, preferably less than 60 mm and most preferably less than 50 mm. The emergency light 1 illustrated in the figures comprises a housing with a maximum width of 41.5 mm.

In one embodiment of the invention, the emergency light device comprises a housing with a maximum length which is less than 150 mm, preferably less than 125 mm and most preferably less than 100 mm. The emergency light 1 illustrated in the figures comprises a housing with a maximum length of 85 mm.

The emergency light device according to the invention is designed to have a minimal height. The maximum height of the emergency light device 1 is the sum of the height of the housing and the height of the transparent dome. The emergency light maximum height is less than approx. 50 mm, preferably less than approx. 35 mm and most preferably less than approx. 26 mm. The emergency light 1 illustrated in the figures has a maximum height of only 23.8 mm. This is achieved by using standard AAA batteries. Three AAA batteries can supply sufficient power to the light source. More power could be provided by type AA batteries but the diameter of a type AA battery is 30-40% larger compared to a type AAA battery.

During assembly of the emergency light device 1 according to the invention, the batteries are placed in the battery holder 5. This battery holder 5 is preferably a standard battery holder for type AA, type AAA or type AAAA batteries. Such a battery holder 5 can be purchased anywhere at a reasonable price helping to keep the emergency light production cost to a minimum. Subsequent to assembling the emergency light 1, the housing is preferably permanently sealed, thereby preventing water, dust, moist and/or the like from entering the housing. With a permanent sealing the contents of the housing, i.e. the light source, the energy source and the electronics, is permanently sealed from the outside in the service life of the emergency light 1. An emergency light with a permanent sealing is more efficiently protected from dust, moist and the like, than a sealed emergency light which can be reopened. When opening a sealed emergency light there is no guarantee that when reclosed the sealing is preserved. Furthermore, reopening the emergency light will expose the inside to moist, dust and the like. With a permanent sealing the inside of the emergency light 1 is sealed from the outside in the lifetime of said emergency light, thereby helping to ensure full functionality in the entire lifetime. For life preserving equipment full functionality during the service lifetime is essential.

In a preferred embodiment of the invention, the emergency light device 1 has a lifetime of minimum 5 years. This service lifetime of minimum 5 years is dictated by IMO. Rules introduced by IMO dictate that within a 5 year period emergency lights must be exchanged and replaced with new. Thereby the service lifetime of an IMO approved marine emergency light is maximum 5 years.

DETAILED DESCRIPTION OF THE INVENTION

AA, AAA and AAAA batteries are dry cell-type batteries commonly used in portable electronic devices with a nominal voltage of 1.5 V.

The AA battery type is known internationally (IEC) as LR6 (alkaline) or R6 (carbon-zinc) or FR6 (Li—$FeS_2$) and measures 51 mm in length (50.1 mm without the button terminal), 13.5-14.5 mm in diameter. The capacity of an alkaline AA battery is typically approx. 2700 mAh with a weight of approx. 23 g. The capacity of a Li/Fe AA battery is typically approx. 3000 mAh with a weight of approx. 15 g.

The AAA battery type is known internationally (IEC) as LR03 (alkaline), R03 (carbon-zinc) or FR03 (Li—$FeS_2$). An AAA battery measures 44.5 mm in length and 10.5 mm in diameter. The capacity of an alkaline AAA battery is typically approx. 1200 mAh with a weight of approx. 11.5 g. The capacity of a Li/Fe AAA battery is typically approx. 1200 mAh with a weight of approx. 7.5 g.

The AAAA battery type is known internationally (IEC) as LR8D425 (alkaline). An AAAA battery measures 42.5 mm in length and 8.3 mm in diameter, weighing approx. 6.5 g. The capacity of an alkaline AAAA battery is typically approx. 625 mAh.

Lithium batteries can provide longer shelf-life compared to alkaline batteries, thereby minimizing battery replacement. Lithium batteries maintain a higher voltage for a longer period than alkaline batteries and the energy density can be much higher than alkaline batteries, but they are more costly. However, lithium batteries such as Li/Fe batteries are still low-cost batteries. Rapid discharge of a lithium battery can result in overheating of the battery, rupture, and even explosion. Because of that, shipping and carriage of lithium batteries is restricted in some situations, particularly transport of lithium batteries by air, such as transport by commercial aircrafts.

In a preferred embodiment of the invention, lithium batteries are used as the energy source, more preferably lithium batteries such as lithium-iron batteries also known as "Li/Fe", wherein iron sulphide (FeS) or iron disulfide ($FeS_2$) is used as the cathode. They are commonly used as replacements for alkaline batteries if a high current is needed. Li/Fe batteries are low-cost and they are commonly provided as standard types AA and AAA. In a preferred embodiment of the invention three Li/Fe AAA batteries are used as the power source keeping the height of the emergency light device to a minimum. Li/Fe batteries are known to have a very long shelf-life, i.e. after several years of storage self-discharging of the batteries is kept to a minimum. The capacity of alkaline and Li/Fe batteries are roughly equal, but with a high current discharge the lifetime of a Li/Fe battery is approx. 2.5 times higher than an alkaline battery. During low current discharge there is no difference in lifetimes between Li/Fe and alkaline batteries. The shelf-life of Li/Fe batteries is typically more than 10 years, typically even more than 15 years. Li/Fe batteries are typically more resistant to storage and operation in unusual climate conditions. Typically storage and operating temperatures for Li/Fe batteries are −40° C. to +60° C. Li/Fe type AA and AAA batteries weigh approx. 30% less than corresponding alkaline type AA and AAA batteries.

In another embodiment of the invention alkaline batteries are used as the energy source. Alkaline batteries are easy to handle, they have very low cost and they have a sufficiently long shelf-life. Unlike batteries containing lithium there are no risks of explosions and/or development of extensive heat, and standard types AA, AAA and AAAA batteries are allowed in commercial aircrafts. In one embodiment of the invention three AAA batteries are used as the power source keeping the height of the emergency light device to a minimum. Alkaline batteries are known to have a long shelf-life, i.e. after several years self-discharging of the batteries is kept to a minimum.

Alkaline batteries stored at room temperature self discharge at a rate of less than two percent per year. Thereby an alkaline battery stored at normal ambient temperatures maintains approximately 85-90% of the initial power after five years. However, if alkaline batteries are stored at higher temperatures they will start to lose capacity much quicker. At 30° C. they only lose about 5% per year, but at 38 degrees they lose approximately 25% per year.

Alkaline batteries can only deliver their full capacity if the power is used slowly. Using an energy efficient light source with a small current drag, such as an LED, ensures a slow power consumption and thereby slow discharge of the alkaline batteries.

Some emergency devices known in the art teaches the use of a 9 volt as the energy source. That might simplify the design, because only one battery must be integrated. However, the height of a 9 volt battery is actually almost 50% higher than standard AAA batteries leading to a more bulky design. And 9 volt is actually too high voltage for a LED.

In a preferred embodiment of the invention, the emergency light device must be replaced at least every five years. Using lithium batteries would ensure a constant voltage in the entire period. But in a period of five years alkaline batteries could also provide substantial electrical power through the entire period and use of alkaline batteries would help to lower the production cost of the device.

Emergency lights for life jackets can be integrated in the life jacket, e.g. by integrating the electronics and/or the energy source inside the life jacket and only providing the light source visible on the outside of the life jacket. But with a requirement of exchanging the emergency light for life jackets at least every five years, an integrated emergency light is not an attractive and cost efficient solution. In addition to complying with the SOLAS directive an emergency light for life jackets must be:

independent from the life jacket,
provided with a minimal height and a minimal volume,
cost efficient,
easy to attach and detach to the life jacket, and
environmentally safe to dispose.

EXAMPLES

The SOLAS directive implies a number of minimum requirements for emergency lights on lifejackets. In a preferred embodiment of the invention the emergency light device complies with all the requirements of the SOLAS directive. The requirements are:

1. A luminous intensity of at least 0.75 cd in all directions of the upper hemisphere.
2. A light source in white colour.
3. A source of energy capable of providing a luminous intensity of at least 0.75 cd for a period of at least 8 hours.
4. Visibility over the greatest possible segment of the upper hemisphere as is practicable when attached to a lifejacket.
5. For a flashing light source the emergency light shall be provided with a manual switch and a flash rate of between 50 and 70 flashes per minute with an effective luminous intensity of at least 0.75 cd.

Requirements 1 and 2 are satisfied by using a white light emitting diode (LED). LEDs have been known for many years but only recently have reliable low-cost white LEDs been commercially available that can provide the required luminous intensity of at least 0.75 cd. The light from a LED is substantially directional. To disperse the light in the upper hemisphere a transparent dome is provided in the housing of the emergency light device according to the invention. The transparent dome is preferably made of a hard plastic material, such as polycarbonate. Dispersion of the light from the LED situated inside the transparent dome is provided by a particular design of the dome.

Requirement 3 is complied with by having a sufficient source of electrical energy. In a preferred embodiment of the invention the electrical energy for the LED is provided by standard batteries, such a type AA of type AAA or even type AAAA, such as for example Li/Fe or alkaline batteries. Requirement 4 is typically complied with by attaching the emergency light to the shoulder straps of the lifejacket.

In a preferred embodiment of the invention the light source of the emergency light device is flashing when the emergency light device is activated. To comply with requirement 5, the electronic circuit provides for the correct flashing frequency and a manual switch is provided on the device. The manual switch is preferably provided in one of the corners of the housing, preferably in a recessed section of one of the corners of the bottom of the housing.

The invention claimed is:

1. An emergency light device for marine use, said emergency light device comprising:

a housing having a first shell member and an opposite second shell member, said first shell member having a rounded corner and a recessed portion adjacent said rounded corner, said rounded corner defining an outer rounded rim of said housing, said housing having a width which is at least double a height of said housing, and said housing having a maximum height of less than 20 mm, an electronic circuit having at least one light emitting diode and an electrical power supply having at least one battery of an AA, AAA, or AAAA type, at least one transparent dome located on said second shell member, said at least one light emitting diode provided in said at least one transparent dome, and at least one manually operated operating switch to control activation and deactivation of said at least one light emitting diode, said switch having a switch handle that is rotatably mounted in said recessed portion, said switch handle having an inner end and an opposite outer end, said outer end protrudes beyond said outer rounded rim of said housing, said manual activation and deactivation of said at least one light emitting diode is provided by rotating said outer end of said switch handle along said outer rounded rim of said housing.

2. The emergency light device according to claim 1, wherein said width of said housing is at least triple said height of said housing.

3. The emergency light device according to claim 1, wherein said first shell member and the second shell member of said housing are permanently sealed.

4. The emergency light device according to claim 1, wherein said rounded corner of said housing substantially forms a circular arc.

5. The emergency light device according to claim 1, wherein said at least one battery is a lithium battery.

6. The emergency light device according to claim 1, wherein said at least one battery is an alkaline battery.

7. The emergency light device according to claim 1, wherein said manually operated switch includes a switch tack connected to said switch handle, said switch tack engages with said electronic circuit to activate and deactivate said at least one light emitting diode due to the rotation of said switch handle.

8. The emergency light device according to claim 7, wherein said inner end of said switch handle is rounded.

9. The emergency light device according to claim 8, wherein said rounded inner end of said switch handle corresponds to said rounded part of said boundary wall of said recessed portion.

10. The emergency light device according to claim 7, wherein said inner end of said switch handle is rounded as a circular arc.

11. The emergency light device according to claim 7, wherein said outer end of said switch handle is adapted to slide along said rounded corner of said housing.

12. The emergency light device according to claim 7, wherein said outer end of said switch handle is adapted to slide along said rounded corner of said housing that forms a circular arc.

13. The emergency light device according to claim 1, wherein a surface bottom of said recessed portion is substantially planar and a boundary wall of said recessed portion is at least partly rounded.

14. The emergency light device according to claim 1, wherein recessed portion is a 90 degree cut-out.

15. The emergency light device according to claim 1, wherein said manually operated switch is adapted to rotate in said recessed portion around an axis perpendicular to a plane of said housing.

16. The emergency light device according to claim 1, wherein said switch handle includes one or more grooves and wherein said recessed portion includes a circular arc ridge positioned on said recessed portion interior of said rounded rim, said ridge and said one or more grooves adapted to engage when rotating said switch handle.

17. The emergency light device according to claim 1, wherein said switch handle is engaged to said switch tack along an axis of rotation of said switch handle, said switch tack providing an electrical contact.

18. The emergency light device according to claim 17, wherein said switch handle is engaged to said switch tack by a trefoil shaped plug-and-socket connection.

19. The emergency light device according to claim 1, further comprising attachment that attaches said emergency light device to a safety device.

20. The emergency light device according to claim 1, wherein a maximum width of said housing is less than 45 mm.

21. The emergency light device according to claim 1, with a maximum length of said housing is less than 100 mm.

22. The emergency light device according to claim 1, wherein the switch handle includes an upper surface that extends flush with an upper planar surface of said first shell member.

* * * * *